US010665986B1

(12) United States Patent
Prado

(10) Patent No.: US 10,665,986 B1
(45) Date of Patent: May 26, 2020

(54) REINFORCEMENT OF MOBILE ELECTRONIC DEVICE CHARGING CABLES / ELECTRICAL CORDS

(71) Applicant: Britney S. Prado, Chester, NJ (US)

(72) Inventor: Britney S. Prado, Chester, NJ (US)

( * ) Notice: Subject to any disclaimer, the term of this patent is extended or adjusted under 35 U.S.C. 154(b) by 0 days.

(21) Appl. No.: 16/371,705

(22) Filed: Apr. 1, 2019

(51) Int. Cl.
*H01R 13/58* (2006.01)

(52) U.S. Cl.
CPC ..... *H01R 13/5829* (2013.01); *H01R 13/5845* (2013.01)

(58) Field of Classification Search
CPC .... H01R 13/562; H01R 13/58; H01R 13/582; H01R 13/5825; H01R 13/5829; H01R 13/5833; H01R 13/5845; G02B 6/4478
See application file for complete search history.

(56) References Cited

U.S. PATENT DOCUMENTS

| | | | | |
|---|---|---|---|---|
| 303,855 | A | 8/1884 | Hunt | |
| 2,472,986 | A * | 6/1949 | Reder, Jr. | H01R 13/562 439/472 |
| 4,501,927 | A * | 2/1985 | Sievert | H02G 15/192 156/49 |
| 4,780,351 | A | 10/1988 | Czempoyesh | |
| 5,070,597 | A | 12/1991 | Holt et al. | |
| 5,094,552 | A * | 3/1992 | Monroe | G02B 6/3887 385/76 |
| 6,457,984 | B1 * | 10/2002 | Montgomery | H01R 13/518 439/131 |
| 6,634,801 | B1 * | 10/2003 | Waldron | G02B 6/3887 385/135 |
| 7,109,594 | B2 | 9/2006 | Liao | |
| 7,119,279 | B2 | 10/2006 | Niehaus et al. | |
| 8,502,069 | B2 | 8/2013 | Holland et al. | |
| 9,437,963 | B1 * | 9/2016 | DeJesu | H01R 13/5812 |
| 9,780,483 | B1 * | 10/2017 | Goulbourne | H01R 13/5812 |
| 10,008,840 | B2 | 6/2018 | Love et al. | |
| 2004/0120656 | A1 * | 6/2004 | Banas | G02B 6/3887 385/86 |
| 2004/0165852 | A1 * | 8/2004 | Erwin | G02B 6/4478 385/135 |

(Continued)

OTHER PUBLICATIONS https://www.amazon.com/BUTEFO-Protector-ProtectiveCompatiblecontained/dp/B0185NA2S8#customerReviews.
http://blog.bunited.com/blog/2015/09/10/consumers-spend-960year-on-cell-phone-charger-cords/.

*Primary Examiner* — Oscar C Jimenez
(74) *Attorney, Agent, or Firm* — Ernest D. Buff & Associates, LLC; Ernest D. Buff; Margaret A. LeCroix

(57) ABSTRACT

A reinforcing add-on, method of use, and method of manufacture facilitates housing a portion of a mobile charging cord to prevent cord damage. The reinforcing add-on comprises mating top and bottom portions having a housing cavity, proximal end, central body, and distal end, with a cord channel extending therebetween. The central body has a proximal section and a distal section meeting at a bend angle θ, wherein θ is an obtuse angle. Side walls having side wall edges extend along the housing cavity, proximal end, central body and distal end, having attachment means for attaching the top and bottom portions to one another to form the reinforcing add-on and house the portion of the mobile charging cord. The reinforcing add-on is appointed to be attached to and house the portion of the mobile charging cord to prevent bend strain and increase the cord's service life.

16 Claims, 3 Drawing Sheets

(56) References Cited

U.S. PATENT DOCUMENTS

| | | | | |
|---|---|---|---|---|
| 2005/0176480 | A1 | 8/2005 | Kemp | |
| 2006/0127025 | A1* | 6/2006 | Haberman | G02B 6/4478 385/134 |
| 2011/0006512 | A1 | 1/2011 | James et al. | |
| 2011/0034257 | A1 | 2/2011 | Wen | |
| 2012/0289081 | A1* | 11/2012 | Izzard | H01R 25/003 439/535 |
| 2014/0348477 | A1* | 11/2014 | Chang | G02B 6/4478 385/135 |
| 2015/0018052 | A1* | 1/2015 | Baschnagel | H04M 1/04 455/575.1 |
| 2015/0222048 | A1* | 8/2015 | Goulbourne | H01R 13/5841 439/456 |
| 2018/0351289 | A1* | 12/2018 | Zaytoun, Jr. | H01R 13/5804 |

* cited by examiner

REINFORCEMENT OF MOBILE ELECTRONIC DEVICE CHARGING CABLES / ELECTRICAL CORDS

FIELD OF THE INVENTION

This disclosure relates to mobile electronic devices; and, more particularly, to a method and apparatus for reinforcement of cell phone charger cords that extend cord life.

BACKGROUND

Mobile electronic devices, particularly cell phones and tablets, have become a mainstay in homes and businesses. These devices are energized by batteries that can be recharged through cables or cords or through wireless charging pads. Charging by means of cables is customary; but with repeated use the cables encounter bend strain, particularly on opposite ends near the Universal Serial Bus (USB) or lightning connector. Vulnerable bend points, particularly near the USB, on the charging cord or cable are susceptible to damage by continuous placement of the charging cord at an angle from the cell phone or electronic device. Over time, repeated bending at the bend point results in internal, and even external, breakage of the electrical cord. As a result, the charging cord eventually fails to charge the device properly and can endanger the user if the wiring is exposed. Replacement of the damaged charging cord is generally required.

Charging cord replacement is oftentimes required after only a few weeks of use. Despite warranties extant for charging cords and advice for repair of damaged chargers, there exists no method or apparatus for mitigating or preventing charging cord damage. Consumers spend over $900 each year to repair or replace broken cell phone charger cords. Lightning cord chargers, such as those associated with the trademark Apple, typically last about 4-12 weeks, depending on the user, how the cord is cared for and the environment it is used in. Based on these averages, a family of four with four cell phones typically goes through approximately 48 phone cords per year. Based on a selling price of roughly $19.00 per replacement cord and a breakage rate of 4-12 weeks of cord use, that family would spend $912.00 on replacement cords every year. See http://blog.bunited.com/blog/2015/09/10/consumers-spend-960year-on-cell-phone-charger-cords/.

Various charging stands and the like have been provided. These charging vehicles require the electronic device or mobile phone to be placed on a stand that houses the charger. Charging stands are relatively heavy and bulky. They are not nearly as portable as charging cables and do not address problems such as wear life, bending and damage to the mobile device charging cord.

Covers for electrical cords have been proposed by the art. Generally, these covers are provided to address problems associated with electrical cords, rather than mobile charger cords, and typically concern means to organize or make electrical cords more attractive. Moreover, these covers are associated with electrical cords, rather than mobile device charging cords, which are much thinner and smaller, and typically encounter repeated manipulation. Furthermore, the covers shroud substantially the entire length of the electrical cord between the plug ends. As a result, the electrical cord is still susceptible to bending at the plug cord interface. When used repeatedly at a bend angle, these covers do not prevent cord damage.

Even where protectors have been provided that are structured to accommodate and protect cell phone charging cords/cables, these devices fail to prevent bend strain and breakage at the cord to micro USB/charger interface where cord bend and strain is most prevalent. As a result, the charging cords associated therewith still suffer breakage and require replacement. Other cover devices compound this problem because they tend to slide down the charger cord, and therefore fail to provide any real bend strain protection. See for example https://www.amazon.com/BUTEFO-Protector-ProtectiveCompatiblecontained/dp/B0185NA2S8#customerReviews.

While strain relieving collars and the like have been provided in the art to address electrical cord end or plug portion wear, these proposed devices are typically integrated with the ends of the electrical cord itself. While tending to provide for bendability of the cord at the cord to plug interface, such strain relieving collars merely provide reinforcement to the cord structure. As a result, the cord to plug interface still provides for bending, and over time the electrical cord remains susceptible to bending and bend strain, and ultimately damage.

There exists a need in the art for methods and apparatus that extend the service life of personal electronic device charger/electrical cords. More particularly, there is a need in the art for a method and apparatus that forestalls bending at stress points along charger cords in order to prevent bend strain and preclude breakage of the cord.

SUMMARY OF THE INVENTION

The present invention is directed toward a method and apparatus for reinforcing mobile/mobile electronic device charging cables/electrical cords to prevent bend strain at one or more vulnerable strain points along the cable/cord. Personal electronic devices or mobile devices include, for nonlimiting example, cell phones, smartphones, laptops, and/or tablets. It is noted that although the subject reinforcement apparatus and method is particularly suitable for mobile/personal electronic devices, it may be utilized for other electrical cords that are subject to repeated bending at sharp angles in substantially the same places. The subject reinforcement device increases the service life of the charging cable/cord by preventing or mitigating strain at one or more points along the cord that are vulnerable to damage through repetitious bending with daily use. Repeated strain-inducing bending at preselected cord locations is forestalled through use of the reinforcement apparatus by securing the cable/cord within the reinforcement device and precluding bending at the vulnerable stress point.

In a first aspect of the invention a reinforcing add-on for housing a portion of a mobile charging cord is provided. The reinforcing add-on comprises mating top and bottom portions each having a housing cavity, a proximal end, a central body, and a distal end, with a cord channel extending therebetween. The central body has a proximal section and a distal section meeting at a bend angle $\theta$, wherein $\theta$ is an obtuse angle. Side walls having side wall edges extend along the housing cavity, proximal end, central body and distal end. The side wall edges have attachment means for attaching the top and bottom portions to one another to form the reinforcing add-on and house the portion of the mobile charging cord. The reinforcing add-on is appointed to be attached to and house the portion of the mobile charging cord to prevent bend strain and increase use life.

A method of using a reinforcing add-on for housing a portion of a mobile charging cord is also provided, comprising the steps of: (1) placing said portion of said mobile charging cord within a mating top or bottom portion comprising: (a) a housing cavity, a proximal end, a central body, and a distal end, with a cord channel extending therebetween; (b) said central body having a proximal section and a distal section meeting at a bend angle θ, wherein θ is an obtuse angle; and (c) said side walls having side wall edges extending along said housing cavity, proximal end, central body, and distal end, said side wall edges having attachment means for attaching said top and bottom portions to one another to form said reinforcing add-on and house said portion of said mobile charging cord; and (2) aligning said top and bottom portion with one another and attaching said top and bottom portion together to form said reinforcing add-on and thereby housing said portion of said mobile charging cord to obviate bend strain and increase use life.

In another aspect of the invention a method of manufacturing a reinforcing add-on for housing a portion of a mobile charging cord is provided, comprising the steps of: (a) forming mating top and bottom portions each having a housing cavity, a proximal end, a central body, and a distal end, with a cord channel extending therebetween, said central body having a proximal section and a distal section meeting at a bend angle θ, wherein θ is an obtuse angle; (b) forming side walls having side wall edges extending along said housing cavity, proximal end, central body, and distal end, said side wall edges having attachment means for attaching said top and bottom portions to one another to form said reinforcing add-on and house said portion of said mobile charging cord; and wherein said reinforcing add-on is appointed to be attached to and house said portion of said mobile charging cord to prevent bend strain and increase service life.

BRIEF DESCRIPTION OF THE DRAWING

The invention will be more fully understood, and further advantages will become apparent when reference is had to the following detailed description of the preferred embodiments of the invention and the accompanying drawings, in which:

FIG. 4*a* is a top plan view of another embodiment of the reinforcing add-on;

FIG. 4*b* is a top plan view of another embodiment of the reinforcing add-on; and FIG. 5 is a top plan view of one or more wraps appointed to be placed over the exterior of the reinforcing add-on.

DETAILED DESCRIPTION OF THE INVENTION

Figure 1:
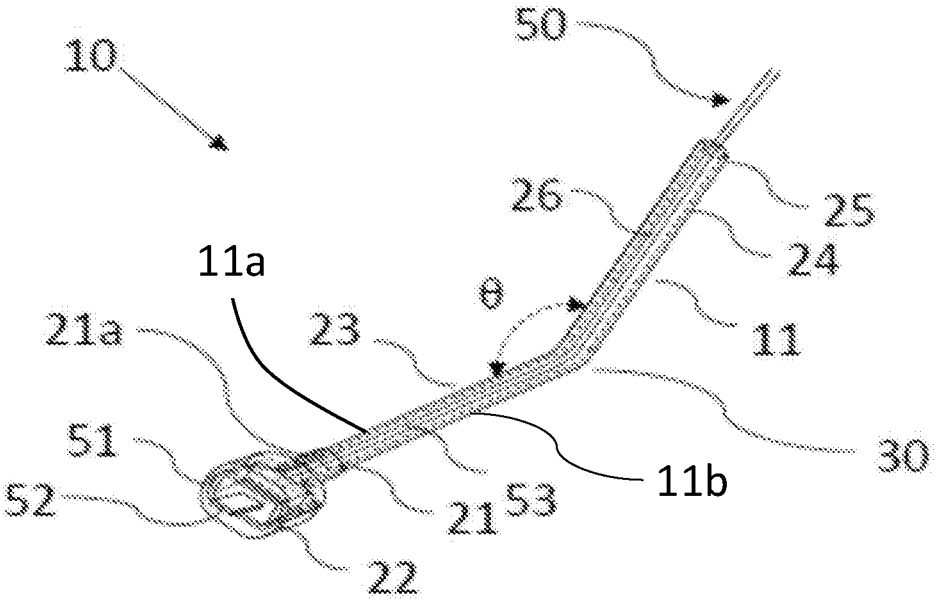
FIG. 1 shows a top plan view of the reinforcing add-on shown secured onto a mobile device charging cable (shown in partial view)

The reinforcing add-on for mobile electronic device charging cables/electrical cords prevents bending forces or strain at one or more vulnerable strain points to extend the life of the charger cord.

Preventing or mitigating strain along the charging cable through use of the subject reinforcement add-on forestalls bend strain damage to the charging cable/cord. Bend points along the charging cable/cord result in strain and, through repeated use, result in damage. These bend points have been found to frequently result at or near the ends of the charging cord near the micro USB/charger connector and/or near the USB/wall outlet prong member. Particularly, the region of the charging cord at the junction of the micro USB/charger connector to cord interface has been found to be most vulnerable. Often the mobile device is in use while charging, and as a result, the junction of the micro USB/charger connector to cord interface bends at relatively sharp bend angles, generally at bend angles ≥45°, but even more frequently at angles ≥90°. Even when not in use during charging, placement of the mobile device on a surface generally also results in sharp bend angles. Prolonged use at the bend angles produces internal bending strain, as well as strain on the exterior shaft of the charging cord. Internal bend strain eventually leads to breakage of the internal cables, and cracking and splitting of the exterior shaft of the charging cord, often exposing internal cables. Not only does the charging cable become ineffective at charging, but the exposure of internal cables presents a safety hazard. Ultimately, the charging cord must be replaced.

The reinforcing add-on of the present invention increases the service life of the charging cable/cord by preventing or mitigating strain at one or more bending points along the cord. Specifically, the reinforcing add-on prevents or mitigates bend strain at the micro USB/charger connector to cord interface. It is noted, however, that the USB/electrical prong to cord interface on the opposite end of the charger cord also can result in strain bending, and in which case the subject reinforcing add-on can also readily be utilized on the USB/electrical prong to cord interface. Repeat strain bending at the strain point(s), (i) the micro USB/charger connector to cord interface, and/or (ii) the USB/electrical prong to cord interface, is virtually eliminated through use of the reinforcement apparatus by securing the cable/cord within the reinforcement device and preventing bending at the vulnerable stress point. It is noted that, as referred to herein, charging cord/cable refers generally to heretofore known and utilized charging cords, including charging cords for Android-based mobile devices, gaming systems and the like, and lightning cable chargers, such as those associated with Apple.

The reinforcing add-on is comprised of mating top and bottom portions that are mated to form the reinforcing add-on. Each of the mating top and bottom portions is constructed having a proximal section terminating to a proximal end, a bend section, and an oppositely arranged distal section terminating to a distal end. It has been found that the farther the radius of the bend is, with the same force and higher torque, the more susceptible the phone charger cord is to breakage. The length of the proximal and distal sections is preferably no longer than 0.7 inches. As the length increases and the bend is located further from the micro USB/charger connector, torque on the cord is increased, and the ability to protect the cord from breakage decreases. Between the proximal and distal sections is a bend, preferably an arched or curved bend. This bend describes an angle θ along the x y z plane, with the x plane extending along the horizontal plane and being a centerline of the proximal section (for geometrical reference). Preferably, θ is an obtuse angle, >90° but less than <180°. Smaller θ has been found to increase the bend and torque strain of a charging cord segment located at the bend.

The reinforcing add-on is composed of durable materials and typically comprises a rigid material that can substantially prevent bending of the cord housed therein. In general, the reinforcing add-on is composed of a rigid, non-deformable material so that the cord and the bend angle θ remain fixed and the cord is free from contortion at the vulnerable bend points. Owing to its compact, small nature, the reinforcing add-on can be used on the go in virtually any location that the charger cord is employed. Advantageously, the reinforcing add-on can be manufactured at low cost. It is readily attached to the charger cord and is easily removed. Materials utilized in forming the reinforcing add-on preferably include polymeric materials, including, one or more thermoplastics, acrylonitrile butadiene styrene (ABS), Poly (lactic acid) or polylactic acid or polylactide (PLA), resins, 3 D printing resins, thermosets, and/or fibers. Low flex material such as rubber and/or silicone may also be utilized as long the cord is not subject to bending within the reinforcing add-on and remains fixed therewithin. The reinforcing add-on may include glow-in-the-dark properties; these properties can be integrated within the polymeric material or present in a coating applied thereto.

Figure 2:
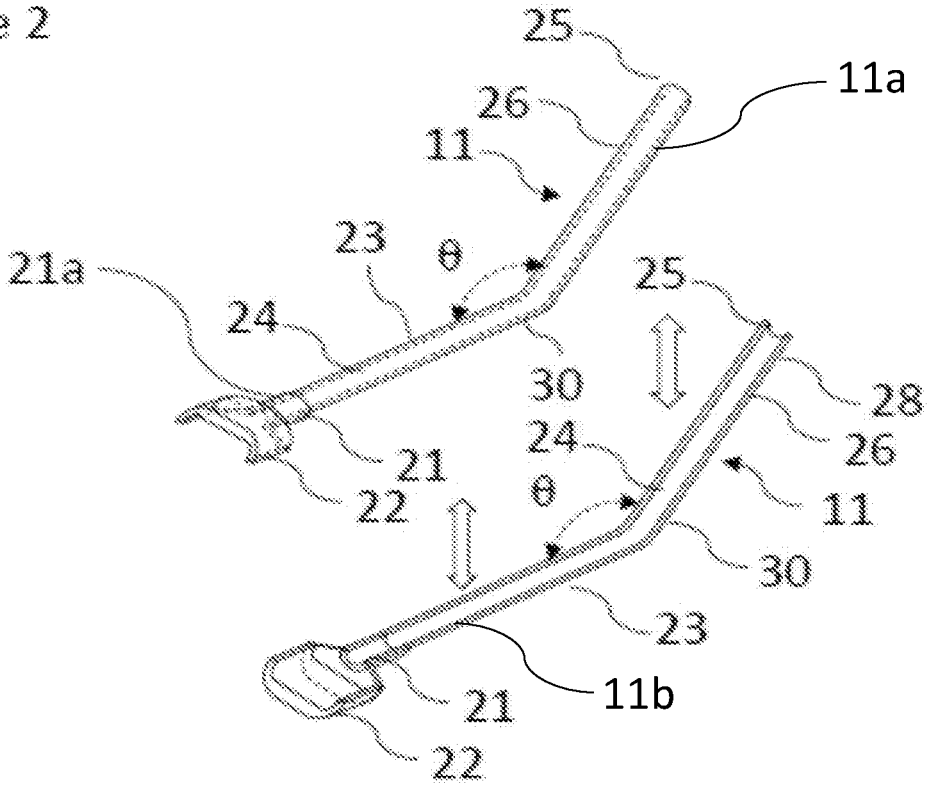
FIG. 2 shows a top plan view of top and bottom portions of the reinforcing add-on of FIG. 1 in the detached configuration.
Figure 3:
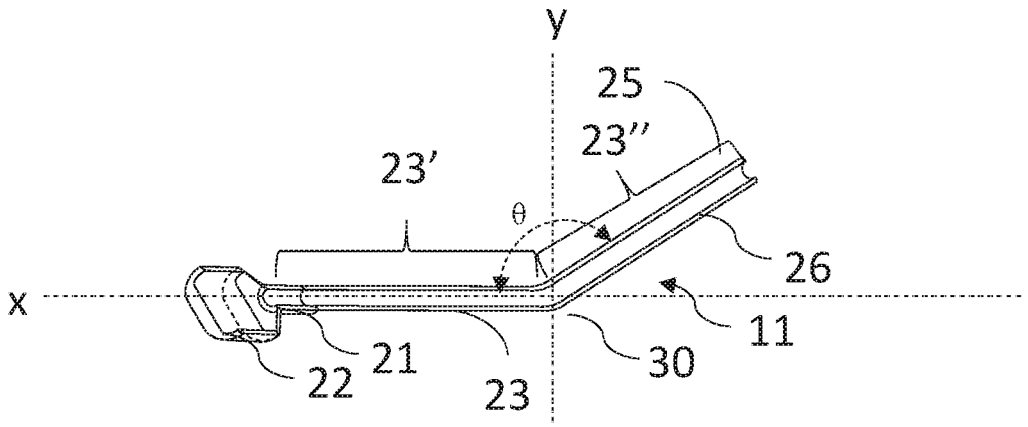
FIG. 3 shows a top plan view of a bottom portion of the reinforcing add-on of FIG. 1, showing θ.

FIG. 1 is a top plan view of the reinforcing add-on secured onto a mobile device charging cable (shown in partial view), referenced generally at 10. FIG. 2 is a top plan view of top and bottom portions of the reinforcing add-on of FIG. 1 in the detached configuration. FIG. 3 is a top plan view of a bottom portion of the reinforcing add-on of FIG. 1, showing θ. Referring to FIGS. 1-3, the reinforcing add-on 10 is constructed of opposingly mating top and bottom portions 11*a*, 11*b*. Top and bottom portions 11*a*, 11*b* are mirror images of one another and are appointed to mate to form the reinforcing add-on 10. A mobile charger cord 50, shown as partial view, is constructed having a first end 51 terminating to a micro USB or charging connector 52 for plug in to a mobile device, a main cord body 53, and an opposite second end (not shown) terminating to USB or pronged plug for insert into a wall outlet.

Reinforcing add-on 10 preferably forms a housing containing a portion of the main body 53 of the cord 50 extending roughly less than about 3 inches from the first end 51 of cord 50, terminating adjacent to the micro USB charger connector 52. Top and bottom portions 11 are constructed having a proximal end 21 having a collar 21*a* terminating at housing cavity 22, a central body 23 having a cord channel 24 terminating to an opposite distal end 25.

Central body 23 includes a rounded bend or rounded angled section 30, having an angle θ. Generally, θ is an obtuse angle or >90° (see FIG. 3) yet less than 180°. Preferably θ ranges from about 100° to about 140°. Each of the proximal end 21, housing cavity 22, central body 23 and distal end 25 have side walls with side wall edges 26 extending there along. Sidewall edges 26 are preferably flat and include attachment means.

Central body 23 is formed of at least two sections, a proximal section 23' and a distal section 23" abutting and interconnected at bend 30. See FIG. 3. Top and bottom portions 11 are constructed with a proximal end 21 having a collar 21*a* terminating a housing cavity 22, a central body 23 having a cord channel 24 terminating to an opposite distal end 25. Preferably, at least one of the housing sections, proximal end, central body 23 and or distal end 25 includes a non-slip surface coating in the cord channel to prevent the reinforcing add-on from sliding on the charging cable or cord.

Preferably, the attachment means is an adhesive surface 28 (having a pull tab covering, not shown) so that the side wall edges 26 are placed upon one another to mate/adhere together to form the reinforcing add-on 10. The attachment means is an adhesive surface on one or more of the top and bottom portions 11. However, the attachment means may alternatively be formed as mating magnetic strips located on the side wall edges 27, mating hook and loop fasteners (such as those sold under the tradename Velcro), or tongue and groove fasteners. The attachment means may be formed as a live hinge that allows the material of the reinforcing add-on to link together to wrap around the charger cord. In another embodiment, the attachment means may be formed as a hinge and clip construct, wherein the top and bottom portions 11 are hinged on one side together and hingedly close and snap together. Other attachment means contemplated include cantilever snap fits, molding snap fits, and/or snap fit joints.

Dimensions of the reinforcing add-on are determined based on the charging cord/cable dimensions so that the reinforcing add-on can readily and snuggly fit on the charging cord/cable. Typical charging cords/cables have a diameter of ~4.09 inches (104 mm) and a micro USB port height of ~0.47 inches (12.0 mm). Preferably the reinforcing add-on has an overall diameter of about 4.13 inches (105 mm) and micro USB port height of about 0.48 inches (12.1 mm in order to provide a snug, secure fit on the charging cord and micro USB port without movement on the charging cable. Most preferably, the reinforcing add-on has an overall diameter of about: $R_d = C_d + 0.005$ mm, wherein $R_d$ is the diameter of the reinforcing add-on in mm; $C_d$ is the diameter of charging cord in mm. Proximal section 23' preferably has a length ranging from about 0.5 inches to about 2 inches. Distal section 23" preferably has a length ranging from about 0.5 inches to about 2 inches, wherein said proximal section has a length p and said distal section has a length d, and p is ≥d. Preferably, the proximal section has a length ranging from about 0.6 inches to about 1.5 inches, and the distal section has a length ranging from about 0.6 inches to 1 inch. Most preferably, the proximal section has a length of about 0.715 inches, and the distal section has a length of about 0.625 inches. The proximal section includes a collar preferably having a length of about 0.4 inches and terminates to a housing cavity having a length of about 0.25 inches.

In operation, a user places micro USB/charger portion 51 within proximal end 21 housing cavity 22 and places local cord body 53 within cord channel 24 of the central body 23 of the reinforcing add-on. Once the cord 53 is placed within the bottom portion 11 of the reinforcing add-on 10, a peel tab (not shown) is removed from sidewall edges 26 and the top portion 11 is aligned and placed directly on top of and piggybacked upon the bottom portion 11, matching side wall edges 26 for flush adhesive bonding between the surfaces of side wall edges 26. Preferably, the reinforcing add-on is composed of a rigid, non-flexible material, so that the reinforcing add-on does not bend or otherwise deform during use, whereby the cord 53 remains fixed without bending or flexing.

Figure 4A:
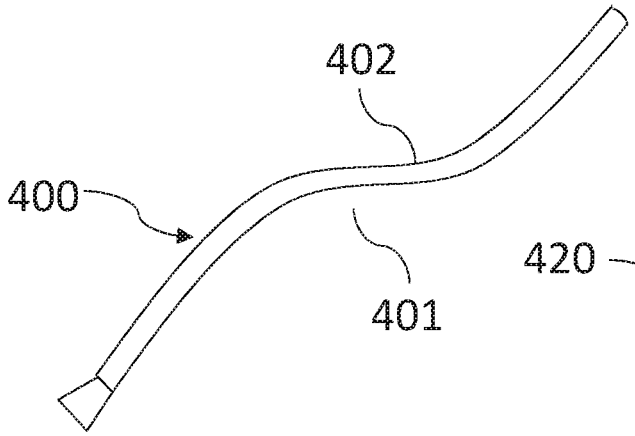
Figure 4B:
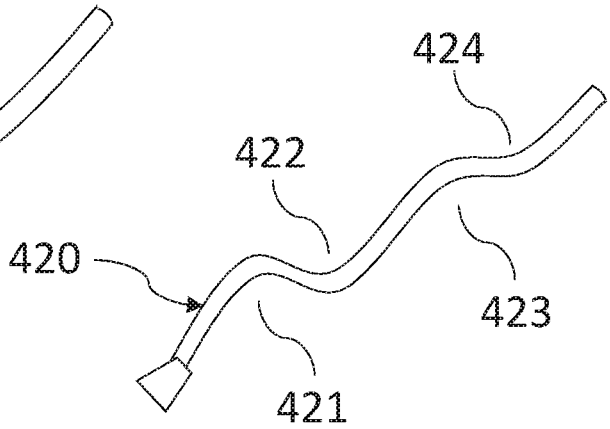

FIGS. 4*a*-4*b* illustrate alternative embodiments of the reinforcing add-on. FIG. 4*a* is a top plan view of an embodiment of the reinforcing add-on 400 wherein there are at least two arched bends, 401 and 402, in the body of the reinforcing add-on. FIG. 4*b* is a top plan view of an embodiment of the reinforcing add-on 420 wherein there are at least four bends, 421, 422, 423 and 424, in the body of the reinforcing add-on.

Figure 5:
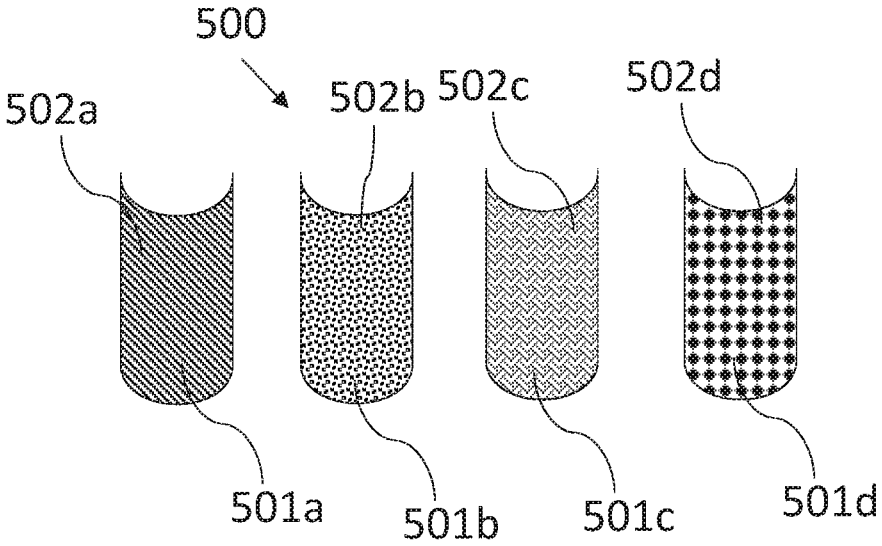

FIG. 5 shows generally at 500 wraps that are adapted to be placed on the reinforcing add-on for decorative purposes or for distinguishing one's charger from another. Wrap 500 is shown with different designs. Wrap 500 preferably includes a decorative face 501 (501*a*-501*d*) and an adhesive back surface 502 (502*a*-502*d*) with a peel tab (not shown) so that when in use the peel tab is removed to expose the adhesive back surface 502 (502*a*-502*b*). The wrap is then adhered to the reinforcing add-on to cover it. The wrap may include a glow-in-the-dark surface coating.

The following examples are provided to more completely describe the system and method described herein. The specific techniques, conditions, materials, proportions and reported data set forth to illustrate the principles and practice of the invention are exemplary only and should not be construed as limiting the scope of the invention.

Examples: Testing of Different Angles θ

| Bend angle θ | Results |
|---|---|
| 180° [proximal section and distal section abutting - forming substantially straight reinforcing add-on with no bend]. | Breakage points moved further down the charging cord at the reinforcing add-on to charging cord termination point. |
| >90° (preferably θ ranging from about 100° to about 140° [arched/curved bend between proximal section and distal section]). | Bend angle θ found to prevent torsion bend forces on the cord to prevent breakage yet provide comfort and give to the charge cord. |
| Two 90° bend angles θ - elbow connector shape. | Breakage points moved to the bend angle θ - too much bend/ strain force at the 90° bend(s). |
| One 90° bend angle θ - L shaped design. | Breakage points moved to the bend angle θ - some bend / strain force at the 90° bend. |

Bend angle θ was found to be most preferably at θ>90° (preferably θ ranging from about 100° to about 140° [arched/curved bend between proximal section and distal section]. Bend angle θ was found to prevent torsion bend forces on the cord to prevent breakage yet provide comfort and "give" to the charge cord. Arched or curved bend angle θ was found preferably to be a 90° bend or right-angle bend as per the L shaped design; arched or curved bend angle θ was found to provide a natural curve for placement of the wire in an optimal in-service position.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A reinforcing add-on for housing a portion of a mobile charging cord, comprising:

(a) mating top and bottom portions each having a housing cavity, a proximal end, a central body, and a distal end, with a cord channel extending therebetween, said mating top and bottom portions being elongated and substantially semi-circular mating so that said reinforcing add-on has an overall diameter adapted to provide a snug, secure fit on said mobile charging cord;

(b) said central body having a proximal section and a distal section meeting at a bend angle θ, wherein θ is an obtuse angle;

(c) side walls having side wall edges extending along said housing cavity, proximal end, central body and distal end, said side wall edges having attachment means for attaching said top and bottom portions to one another to form said reinforcing add-on and house said portion of said mobile charging cord;

wherein said reinforcing add-on is appointed to be attached to and house said portion of said mobile charging cord to prevent bend strain and increase service life.

2. The reinforcing add-on as recited by claim 1, wherein θ ranges from about 100° to about 140°.

3. The reinforcing add-on as recited by claim 1, wherein said attachment means comprises an adhesive surface on one or more of the top and bottom portions.

4. The reinforcing add-on as recited by claim 1, wherein said attachment means comprises mating magnetic strips located on said side wall edges.

5. The reinforcing add-on as recited by claim 1, wherein said attachment means comprises mating hook and loop strips.

6. The reinforcing add-on as recited by claim 1, wherein said attachment means is a member selected from the group consisting of a live hinge, cantilever snap fits, molding snap fits, and snap fit joints.

7. The reinforcing add-on as recited by claim 1, wherein said housing cavity is sized to accommodate a micro USB or charging connector having a mirco USB port.

8. The reinforcing add-on as recited by claim 1, wherein at least one of said housing section, proximal end, central body and distal end includes a non-slip surface coating in said cord channel to prevent said reinforcing add-on from sliding on said mobile charging cord.

9. The reinforcing add-on as recited by claim 1 comprising at least one wrap that covers said reinforcing add-on.

10. The reinforcing add-on as recited by claim 1, wherein said bend angle θ is a curved or arched bend.

11. The reinforcing add-on as recited by claim 1, wherein each of said proximal section and distal section has a length ranging from about 0.5 inches to about 2 inches.

12. The reinforcing add-on as recited by claim 1, wherein said proximal section terminates to a housing cavity adapted to receive a micro USB/charger portion of said mobile charging cord, wherein said proximal section has a length p and said distal section has a length d, wherein p is ≥d.

13. The reinforcing add-on as recited by claim 1, wherein said top and bottom portions are composed of a polymeric material.

14. The reinforcing add-on as recited by claim 1, wherein said top and bottom portions are composed of a rigid, non-bending, material.

15. A method of using a reinforcing add-on for housing a portion of a mobile charging cord, comprising the steps of:

(a) placing said portion of said mobile charging cord within a mating top or bottom portion comprising:

i. a housing cavity, a proximal end, a central body, and a distal end, with a cord channel extending therebetween, said mating top and bottom portions being elongated and substantially semi-circular mating so that said reinforcing add-on has an overall diameter adapted to provide a snug, secure fit on said mobile charging cord;

ii. said central body having a proximal section and a distal section meeting at a bend angle θ, wherein θ is an obtuse angle;

iii. said side walls having side wall edges extending along said housing cavity, proximal end, central body and distal end, said side wall edges having attachment means for attaching said top and bottom portions to one another to form said reinforcing add-on and house said portion of said mobile charging cord;

(b) aligning said top and bottom portion with one another and attaching said top and bottom portion together to form said reinforcing add-on and thereby housing said portion of said mobile charging cord to prevent bend strain and increase service life.

16. A method of manufacturing a reinforcing add-on for housing a portion of a mobile charging cord, comprising the steps of:

(a) forming mating top and bottom portions each having a housing cavity, a proximal end, a central body, and a distal end, with a cord channel extending therebetween, said mating top and bottom portions being elongated and substantially semi-circular mating so that said reinforcing add-on has an overall diameter adapted to provide a snug, secure fit on said mobile charging cord, said central body having a proximal section and a distal section meeting at a bend angle θ, wherein θ is an obtuse angle;

(b) forming side walls having side wall edges extending along said housing cavity, proximal end, central body and distal end, said side wall edges having attachment means for attaching said top and bottom portions to one another to form said reinforcing add-on and house said portion of said mobile charging cord;

wherein said reinforcing add-on is appointed to be attached to and house said portion of said mobile charging cord to prevent bend strain and increase service life.

* * * * *